US010234813B2

(12) United States Patent
Oh et al.

(10) Patent No.: US 10,234,813 B2
(45) Date of Patent: Mar. 19, 2019

(54) IMAGE FORMING APPARATUS AND METHOD OF CONTROLLING THE SAME

(71) Applicant: S-PRINTING SOLUTION CO., LTD., Suwon-si, Gyeonggi-do (KR)

(72) Inventors: Hyun-taek Oh, Suwon-si (KR); Jin-ho Park, Yongin-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 136 days.

(21) Appl. No.: 15/445,296

(22) Filed: Feb. 28, 2017

(65) Prior Publication Data

US 2017/0364021 A1 Dec. 21, 2017

(30) Foreign Application Priority Data

Jun. 21, 2016 (KR) ..... 10-2016-0077316

(51) Int. Cl.

| | |
|---|---|
| ***G03G 15/00*** | (2006.01) |
| ***G03G 21/00*** | (2006.01) |
| ***G03G 21/14*** | (2006.01) |
| ***B65H 1/00*** | (2006.01) |
| ***B65H 5/00*** | (2006.01) |
| ***B65H 29/00*** | (2006.01) |

(52) U.S. Cl.
CPC ..... *G03G 15/80* (2013.01)

(58) Field of Classification Search
CPC ..... G03G 15/00; G03G 15/80; G03G 21/00; G03G 21/14; B65H 1/00; B65H 5/00; B65H 29/00
See application file for complete search history.

(56) References Cited

U.S. PATENT DOCUMENTS

| | | | | |
|---|---|---|---|---|
| 5,125,636 | A * | 6/1992 | Higashio | G03G 15/50 271/9.06 |
| 6,048,060 | A * | 4/2000 | Narushima | B41J 11/002 101/419 |
| 7,980,547 | B2 | 7/2011 | Ito et al. | |
| 2005/0051942 | A1 | 3/2005 | Kubo et al. | |
| 2005/0189695 | A1 | 9/2005 | Kim | |
| 2005/0238377 | A1 * | 10/2005 | Morikawa | H04N 1/0035 399/81 |

(Continued)

FOREIGN PATENT DOCUMENTS

| | | | | |
|---|---|---|---|---|
| JP | 11-11714 | | 1/1999 | |
| JP | 2000138775 | A * | 5/2000 | H04N 1/00 |

(Continued)

OTHER PUBLICATIONS

PCT International Searching Authority (ISA) Written Opinion (7 pages) and Search Report (3 pages) in International Application No. PCT/KR2017/001966 dated May 30, 2017 (total pages 10).

*Primary Examiner* — Nguyen Q. Ha
(74) *Attorney, Agent, or Firm* — Staas & Halsey LLP

(57) ABSTRACT

An image forming apparatus includes a tray feeder to feed a printing medium placed on a tray of the image forming apparatus to an image former of the image forming apparatus, the tray moveable to be in a first position and a second position, a cassette feeder to feed a printing medium placed in a cassette of the image forming apparatus to the image former, a power train to transmit power generated from a driving motor, and a power switching unit to switch the power transmitted from the power train.

20 Claims, 10 Drawing Sheets

(56) References Cited

U.S. PATENT DOCUMENTS

| | | | | |
|---|---|---|---|---|
| 2006/0159481 | A1* | 7/2006 | Horiuchi | B41J 13/103 399/88 |
| 2008/0203650 | A1 | 8/2008 | Ito et al. | |
| 2009/0045566 | A1 | 2/2009 | Nakamura | |
| 2011/0115154 | A1* | 5/2011 | Fujiwara | G03G 15/6511 271/228 |
| 2013/0336667 | A1* | 12/2013 | Watanabe | G03G 15/6555 399/23 |

FOREIGN PATENT DOCUMENTS

| | | |
|---|---|---|
| JP | 2008-213959 | 9/2008 |
| JP | 2009-40605 | 2/2009 |
| JP | 2010-197463 | 9/2010 |
| JP | 2011-241055 | 12/2011 |
| JP | 2016-000652 | 1/2016 |
| JP | 2016-090954 | 5/2016 |
| KR | 10-2005-0075675 | 7/2005 |
| KR | 10-0561478 | 3/2006 |

* cited by examiner

IMAGE FORMING APPARATUS AND METHOD OF CONTROLLING THE SAME

CROSS-REFERENCE TO RELATED APPLICATIONS

This application claims priority from Korean Patent Application No. 10-2016-0077316, filed on Jun. 21, 2016 in the Korean Intellectual Property Office, the disclosure of which is incorporated herein by reference in its entirety.

BACKGROUND OF THE INVENTION

1. Field of the Invention

Apparatuses and methods consistent with the present disclosure relate to an image forming apparatus and a method of controlling the same, for feeding printing media through two or more trays.

2. Description of the Related Art

In general, a widely used image forming apparatus includes a cassette which is a main feeder that supplies printing media to an image former of a main body of the image forming apparatus and supplies placed printing media in the cassette to the image former of the main body while being coupled to the main body, and a multipurpose tray which is an auxiliary device that supplies separately placed printing media to the image former of the main body while being positioned at a use position according to need of users, and supplies printing media placed in the cassette or the multipurpose tray to the image former of the main body on a sheet-by-sheet basis.

In general, the image forming apparatus is configured to simultaneously supply power to both the cassette and the multipurpose tray through a single driving motor and, thus, although printing media is supplied to the image former of the main body through only one of the cassette and the multipurpose tray, power is supplied to both the cassette and the multipurpose tray and, thus, power is unnecessarily consumed and noise is generated.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides an image forming apparatus and a method of controlling the same, for enhancing efficiency of feeding of printing media through a cassette or a multipurpose tray.

According to an aspect of the present disclosure, an image forming apparatus for selectively feeding printing media to an image former of a main body through a cassette and a multipurpose tray includes a tray feeder configured to feed printing media placed in the multipurpose tray, a cassette feeder configured to feed printing media placed in the cassette, a power train configured to transmit power generated from a driving motor, and a power switching unit configured to transmit power transmitted to the power train to the tray feeder or the cassette feeder as the multipurpose tray is moved to a use position or a non-use position.

According to another aspect of the present disclosure, an image forming apparatus for selectively feeding printing media to an image former of a main body through a cassette and a multipurpose tray includes a tray feeder configured to feed printing media placed in the multipurpose tray, a cassette feeder configured to feed printing media placed in the cassette, a power train including a plurality of gears configured to transmit power generated from a driving motor, and a power switching unit configured to be operatively associated with the multipurpose tray to connect the power train to the tray feeder when the multipurpose tray is in a use position and to connect the power train to the cassette feeder when the multipurpose tray is in a non-use position.

According to another aspect of the present disclosure, a method of controlling an image forming apparatus for selectively feeding printing media to an image former of a main body through a cassette feeder configured to feed printing media placed in a cassette and a tray feeder configured to feed printing media placed in a multipurpose tray includes detecting a position of a power switching unit configured to selectively transmit power to any one of the cassette feeder and the tray feeder in association with the multipurpose tray, and recognizing a feeding method from the cassette or the multipurpose tray according to the detected position of the power switching unit.

Additional and/or other aspects and advantages of the invention will be set forth in part in the description which follows and, in part, will be obvious from the description, or may be learned by practice of the invention.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION OF THE PREFERRED EMBODIMENTS

Figure 1:
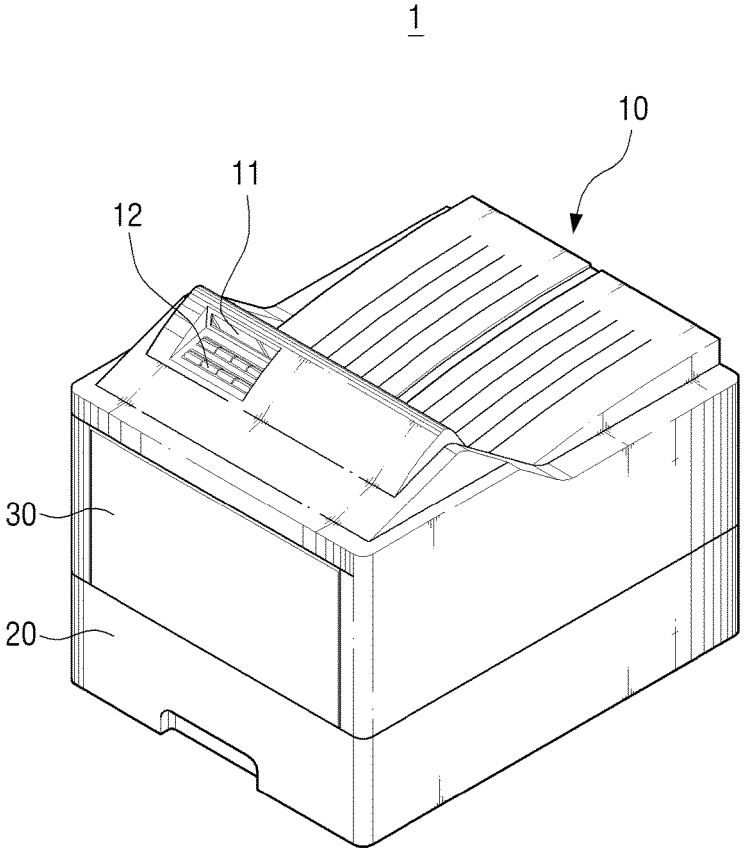
FIG. 1 is a schematic perspective view of an image forming apparatus according to an exemplary embodiment of the present disclosure.

Certain exemplary embodiments of the present disclosure will now be described in greater detail with reference to the accompanying drawings. The following exemplary embodiments will be described based on exemplary embodiments that are most appropriate to understand technical features of the present disclosure and the technical features of the present disclosure are exemplified to embody the following exemplary embodiments rather than being limited by the exemplary embodiments of the present disclosure.

Accordingly, the present disclosure may be modified in various forms within the technological range of the present disclosure through the following exemplary embodiments and the modified exemplary embodiment may be within the technological range of the present disclosure. In addition, with regard to reference numerals denoted in the attached drawings for understanding of the following exemplary embodiments, related components among components functions as the same functions are denoted by the same or similar numerals in each exemplary embodiment of the present disclosure.

Figure 2:
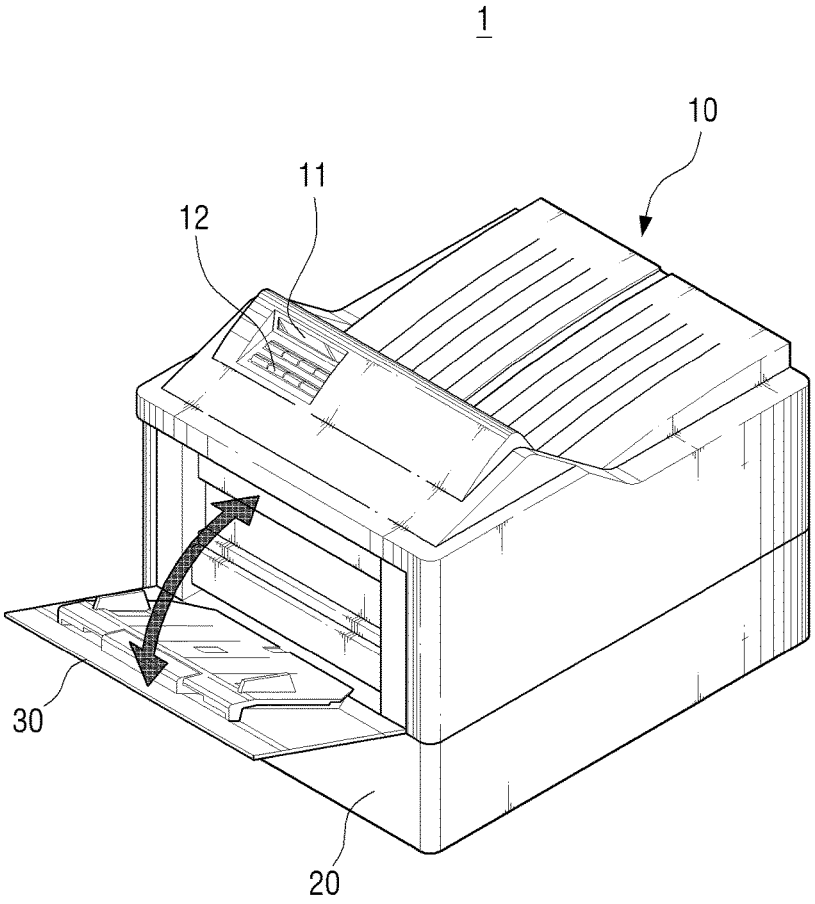
FIG. 2 is a perspective view of a state in which a multipurpose tray of the image forming apparatus illustrated in FIG. 1 is positioned at a use position.

FIG. 1 is a schematic perspective view of an image forming apparatus 1 according to an exemplary embodiment of the present disclosure. FIG. 2 is a perspective view of a state in which a multipurpose tray 30 of the image forming apparatus 1 illustrated in FIG. 1 is positioned at a use position.

Hereinafter, a schematic structure of the image forming apparatus 1 will be described with reference to FIGS. 1 and 2.

The image forming apparatus 1 according to an exemplary embodiment of the present disclosure may be a printer, a copier, a scanner, a facsimile device, or the like and may be a multi function peripheral (MFP) that complexly embodies functions of these through one device.

As illustrated in FIGS. 1 and 2, the image forming apparatus 1 may include a main body 10, a cassette 20, and a multipurpose tray 30, and the main body 10 may include a display unit 11 for indicating information of the image forming apparatus 1 and an input unit 12 for inputting a command by a user.

The main body 10 may include an image former (not shown) for forming an image about printing media (e.g., a printing sheet), a paper discharger (not shown) for discharging the printing media with the image formed thereon out of the main body 10, and a paper feeder (not shown) for moving printing media that are piled, stacked or placed in the cassette 20 or the multipurpose tray 30 to the image former and may further include a driving motor (not shown) for driving the image forming apparatus 1 and a controller (not shown) for controlling the image forming apparatus 1.

The cassette 20 may pile predetermined printing media and may be coupled to a lower end portion of the main body 10 so as to feed the placed printing media to the image former of the main body 10.

The image forming apparatus 1 according to an exemplary embodiment of the present disclosure is illustrated in such a way that the cassette 20 is inserted into the lower end portion of the main body 10 so as to supply printing media to the image former of the main body 10, the cassette 20 may be replaced with a paper feeding tray with various forms and shapes. In addition, two or more cassettes 20 may be configured and coupled to the main body 10.

The multipurpose tray 30 may be moveably coupled to the main body 10 so as to be moved to a use position or a non-use position. For example, as illustrated in FIGS. 1 and 2, the multipurpose tray 30 may be rotatably coupled to one surface of the main body 10 in terms of the lower end portion of the multipurpose tray 30 so as to be rotated between the use position or the non-use position. For example, the use position is when the multipurpose tray 30 is opened or on position so that the print media can be placed in the multipurpose tray 30 and fed to the image former, and the non-use position is when the multipurpose tray 30 is closed or off position. In this example, the use position can be called, "open position" or "on position" and the non-use position can be called, "closed position" or "off-position."

In detail, the multipurpose tray 30 may be rotatably coupled to the main body 10 between the non-use position in which the multipurpose tray 30 is folded on one surface of the main body 10, as illustrated in FIG. 1, and the use position in which the multipurpose tray is unfolded from the main body 10 so as to pile printing media, as illustrated in FIG. 2.

When the multipurpose tray 30 is positioned at the use position, the multipurpose tray 30 may open a printing media inlet formed at one side of the main body 10 so as to feed printing media placed in the multipurpose tray 30 to the image former of the main body 10 through the printing media inlet.

Although the multipurpose tray 30 is illustrated to be rotatably coupled to one side of the main body 10 in FIGS. 1 and 2, the multipurpose tray may be configured in the form of a drawer formed by slidably coupling a plurality of plates.

Thereby, the multipurpose tray may slidably extend from one surface of the main body 10 to be moved to the use position or the non-use position. In addition, the multipurpose tray may be modified to various forms for moving the multipurpose tray to the use position and the non-use position.

A selectively feeding method of printing media placed in the cassette 20 and the multipurpose tray 30 will be described below in more detail.

Figure 3:
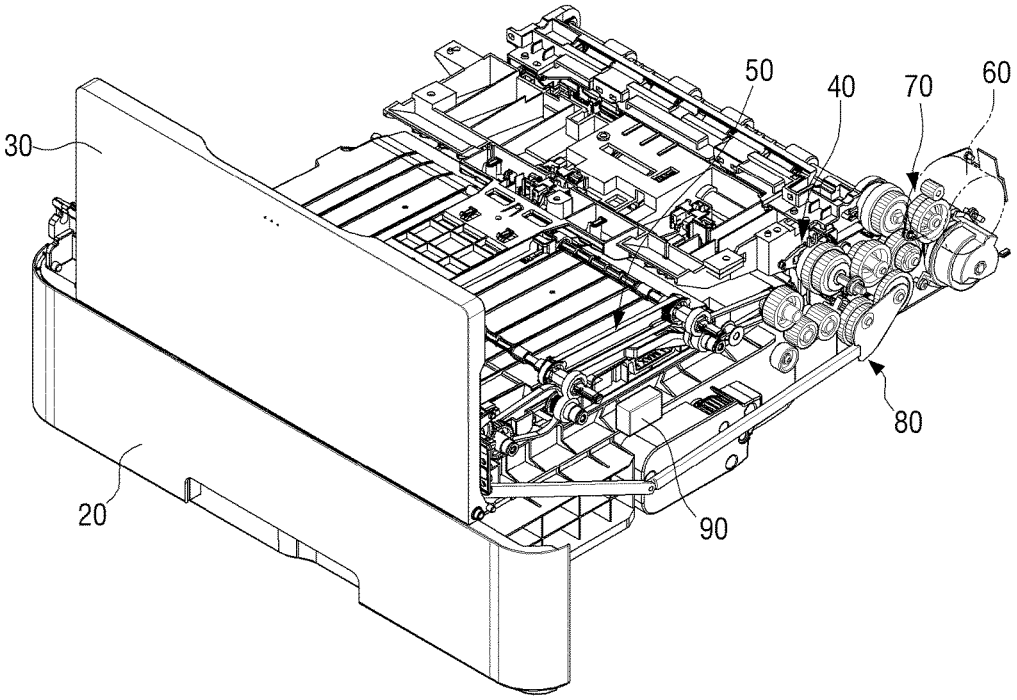
FIG. 3 is a perspective view illustrating some components of an image forming apparatus including a power switching unit in a state in which a multipurpose tray of an image forming apparatus is positioned at a non-use position, according to an exemplary embodiment of the present disclosure.
Figure 4:
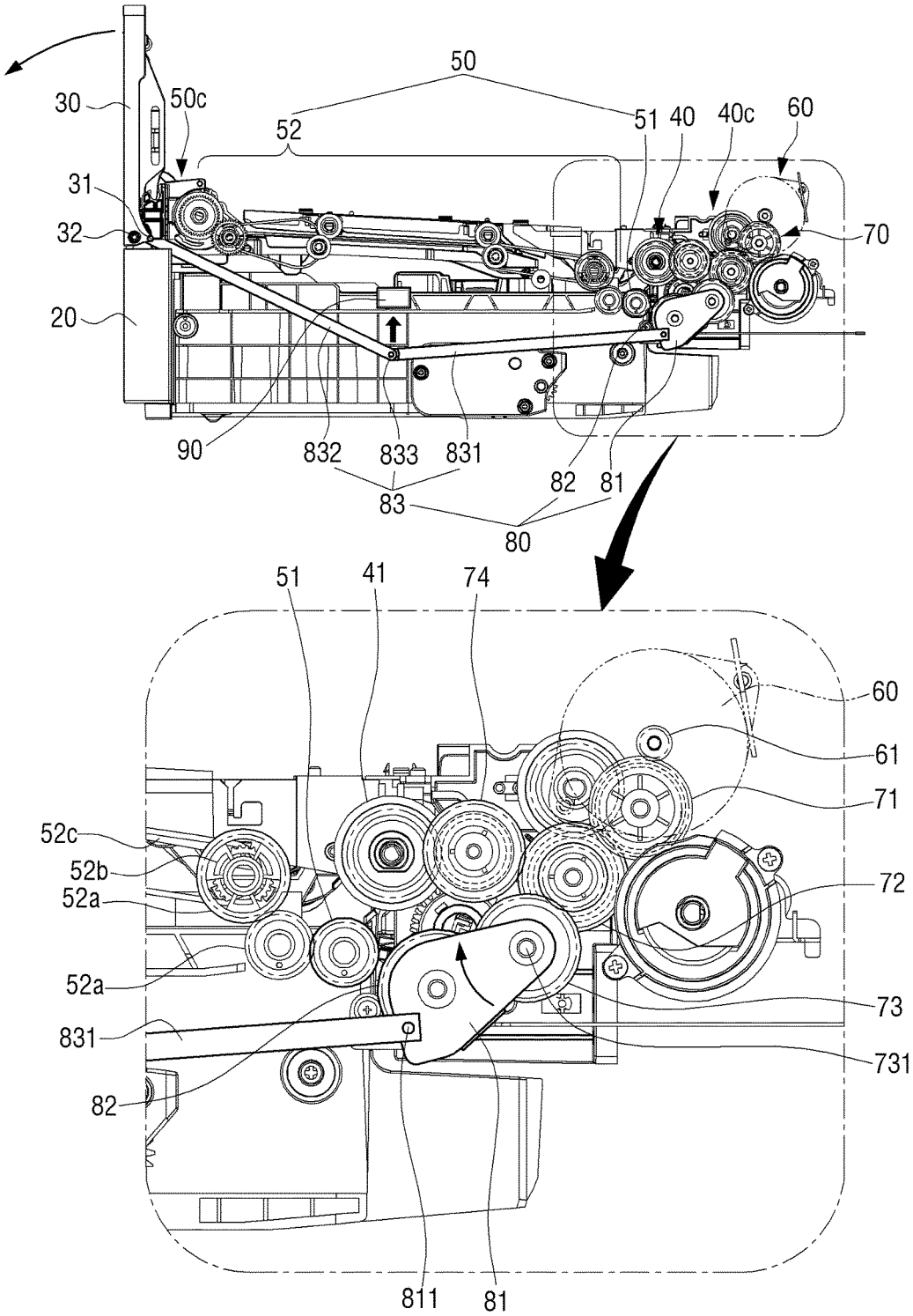
FIG. 4 is a side view illustrating some components of an image forming apparatus including a power switching unit illustrated in FIG. 3.
Figure 5:
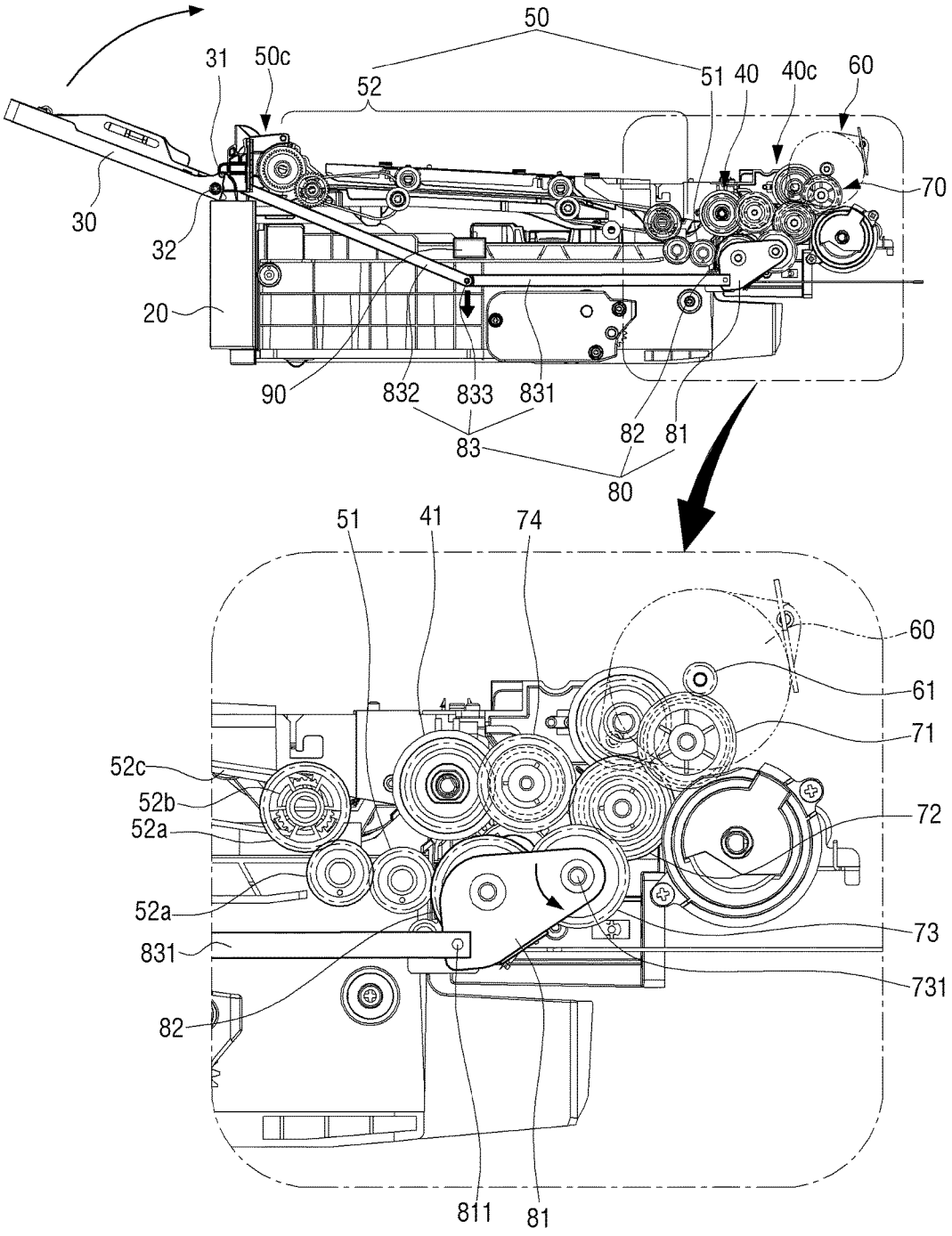
FIG. 5 is a side view illustrating some components of an image forming apparatus including a power switching unit in a state in which a multipurpose tray illustrated in FIG. 4 is positioned at the use position.

FIG. 3 is a perspective view illustrating some components of the image forming apparatus 1 including a power switching unit 80 in a state in which the multipurpose tray 30 of the image forming apparatus 1 is positioned at the non-use position, according to an exemplary embodiment of the present disclosure. FIG. 4 is a side view illustrating some components of the image forming apparatus 1 including the power switching unit 80 illustrated in FIG. 3. FIG. 5 is a side view illustrating some components of the image forming apparatus 1 including the power switching unit 80 in a state in which the multipurpose tray 30 illustrated in FIG. 4 is positioned at the use position.

Hereinafter, with reference to FIGS. 3 to 5, a structure for selectively moving printing media placed in the cassette 20 and the multipurpose tray 30 of the image forming apparatus 1 to the image former of the main body 10 will be described in detail with regard to an exemplary embodiment of the present disclosure.

The image forming apparatus 1 may include a paper feeder for moving the printing media placed in the cassette 20 or the multipurpose tray 30 to the image former.

In detail, the paper feeder may include a cassette feeder 40 for feeding printing media placed in the cassette 20 to the image former of the main body 10, a tray feeder 50 for feeding printing media placed in the multipurpose tray 30 to the image former of the main body 10, a driving motor 60 for supplying power to the paper feeder, a power train 70 for transmitting power generated by the driving motor 60, and the power switching unit 80 that is connected to the multipurpose tray 30 and is operatively associated with the multipurpose tray 30.

The driving motor 60 may be a motor and driving force of the driving motor 60 may be transmitted to the cassette feeder 40 and the tray feeder 50 so as to feed printing media placed in the cassette 20 or the multipurpose tray 30 to the image former of the main body 10.

The driving motor 60 may transmit power to the cassette feeder 40 and the tray feeder 50 through the power train 70 including a plurality of gears and, for example, the power train 70 may include first to fourth engaging gears 71 to 74. In FIGS. 4 and 5, in order to enhance visibility of a connection structure of gears, a teeth structure of a gear is omitted.

The driving motor 60 may further include a power gear 61 that is connected to a shaft of the driving motor 60 in order to transmit power to the first to fourth gears 71 to 74, and the power gear 61 and the first gear 71 engage with each other so as to transmit rotation force generated from the driving motor 60 through the power train 70.

The power train 70 may transmit power of the driving motor 60 through a pulley and a belt connected to the pulley as well as a plurality of gears and may include various components for transmitting power.

The power train 70 may transmit power to the cassette feeder 40 such that the cassette feeder 40 feeds printing media placed in the cassette 20 to the image former of the main body 10.

In detail, the cassette feeder 40 may include a first feeding gear 41 that engages with the fourth gear 74 and a first feeding roller (not shown) that is operatively associated with the first feeding gear 41 and may transmit power to the first feeding roller through the first feeding gear 41 such that the first feeding roller picks up printing media placed in the cassette 20 and moves the printing media to the image former.

The cassette feeder 40 may further include a first clutch 40*c* for shutting off power transmitted from the power train 70 to the first feeding roller when the multipurpose tray 30 is positioned at the use position so as to feed printing media to the image former of the main body 10 through the multipurpose tray 30, thereby preventing printing media placed in the cassette 20 and the multipurpose tray 30 from being simultaneously fed to the image former of the main body 10.

When printing media placed in the cassette 20 is fed through the cassette feeder 40, the first clutch 40*c* may also repeatedly transmit and shut off power to the first feeding roller so as to feed printing media placed in the cassette 20 to the image former of the main body 10 on a sheet-by-sheet basis.

Feeding of printing media through the cassette feeder 40 is the same or similar to the related art and, thus, a detailed description thereof will be omitted here.

The power switching unit 80 may be connected to the multipurpose tray 30 and operatively associated with the multipurpose tray 30 and, thus, when the multipurpose tray 30 is positioned at the use position, the power train 70 may be connected to the tray feeder 50, and when the multipurpose tray 30 is positioned at the non-use position, the power train 70 may be disconnected from the tray feeder 50.

In detail, the power switching unit 80 may include a first swing member 81, a first swing gear 82, and a link member 83.

The first swing member 81 may have one end that is rotatably connected to a shaft of any one of a plurality of gears included in the power train 70. As illustrated in FIGS. 3 to 5, the first swing member 81 may have one end that is rotatably connected to a shaft 731 of the third gear 73 so as to be rotated around the shaft 731 of the third gear 73.

The first swing gear 82 may disposed at the other end of the first swing member 81 so as to engage with the third gear 73.

The link member 83 may connect the first swing member 81 and the multipurpose tray 30.

Accordingly, the link member 83 may be operated together as the multipurpose tray 30 is moved to the use position or the non-use position and may rotate the first swing member 81 connected to the link member 83 around the shaft 731 of the third gear 73.

The link member 83 may include a first rod 831 with one end that is pivotally connected to a connector 811 of the first swing member 81 and a second rod 832 with one end that is pivotally connected to the other end of the first rod 831 and the other end that is pivotally connected to a connector 31 of the multipurpose tray 30.

The link member 83 may include a wire as well as coupling between the first and second rods 831 and 832.

As such, the first swing gear 82 disposed in the first swing member 81 may be positioned at a first connection position in which the first swing gear 82 is connected to the tray feeder 50 or a first disconnection position in which the first swing gear 82 is disconnected from the tray feeder 50 according to rotation of the first swing member 81.

In detail, the tray feeder 50 may include a second feeding gear 51 that engages with the first swing gear 82 according to rotation of the first swing member 81, a second feeding roller (not shown) for picking up printing media from and feeding the printing media to the image former, and a second feeding driver 52 that is connected to the second feeding gear 51 so as to transmit power transmitted through the second feeding gear 51 to the second feeding roller.

The second feeding roller may be adjacently disposed to the multipurpose tray 30 so as to pick up printing media placed in the multipurpose tray 30 positioned at the use position and may be driven by sequentially receiving power through the second feeding gear 51 and the second feeding driver 52.

The second feeding driver 52 may include a plurality of gears 52*a*, a pulley 52*b*, and a belt 52*c* for connecting the gears 52*a* and the pulley 52*b*, and the gears 52*a* included in the second feeding driver 52 may be integrally coupled to the pulley 52*b*.

Hereinafter, a structure in which the power switching unit 80 is connected to or disconnected from the tray feeder 50 according to movement of the multipurpose tray 30 will be described with reference to FIGS. 4 and 5.

As described above, the multipurpose tray 30 may be rotatably connected to the main body 10 so as to be moved to the use position or the non-use position. As illustrated in FIGS. 4 and 5, the multipurpose tray 30 may be rotated around a rotation shaft 32 at a lower end of the multipurpose tray 30 so as to be converted into the non-use position in which the multipurpose tray 30 is folded to one side of the main body 10 and the use position in which the multipurpose tray 30 is unfolded from the main body 10.

As illustrated in FIG. 4, when the multipurpose tray 30 is positioned at the non-use position, the first swing gear 82 connected to the first swing member 81 may be positioned at the first disconnection position in which the first swing gear 82 is disengaged from the second feeding gear 51 of the tray feeder 50.

Accordingly, power transmitted to the first swing gear 82 through the third gear 73 may not be transmitted to the second feeding gear 51 and, thus, the tray feeder 50 may not be driven and the second feeding roller that is operatively associated with the tray feeder 50 may also not be driven.

As illustrated in FIG. 5, when the multipurpose tray 30 is converted to the use position from the non-use position, the link member 83 may be moved according to movement of the multipurpose tray 30 through the second rod 832 that is pivotally connected to the connector 31 of the multipurpose tray 30.

The first swing member 81 that is pivotally connected to the first rod 831 may be rotated based on the shaft 731 of the third gear 73 according to movement of the link member 83 and, thus, the first swing gear 82 and the second feeding gear 51 may engage with each other so as to transmit power to the tray feeder 50.

In FIGS. 4 and 5, the multipurpose tray 30 may be rotated in an external direction of the main body 10 around the rotation shaft 32 in order to move the multipurpose tray 30 to the use position so as to pull the link member 83 in the external direction of the main body 10.

Accordingly, the first swing member 81 may be pulled based on the connector 811 disposed at a lower end portion of the first swing member 81 so as to rotate the first swing member 81 clockwise and, thus, the first swing gear 82 may be positioned at the first connection position in which the first swing gear 82 is engaged with the second feeding gear 51.

As such, as the first swing gear 82 and the second feeding gear 51 are engaged while the multipurpose tray 30 is positioned at the use position, printing media placed in the multipurpose tray 30 may be fed to the image former of the main body 10 through the second feeding roller so as to develop an image on the printing media through the image former.

When the multipurpose tray 30 is positioned at the use position, the first clutch 40*c* of the cassette feeder 40 may shut off power transmitted from the power train 70 to the first feeding roller so as to prevent printing media placed in the cassette 20 from being fed to the image former of the main body 10.

The tray feeder 50 may further include a second clutch 50*c* that repeatedly transmit and shut off power to the second feeding roller so as to feed printing media placed in the multipurpose tray 30 to the image former of the main body 10 on a sheet-by-sheet basis.

When the multipurpose tray 30 is converted into the non-use position from the use position, the link member 83 may rotate the first swing member 81 counterclockwise according to movement of the multipurpose tray 30 such that the first swing gear 82 may be positioned at the first disconnection position in which the first swing gear 82 is disengaged from the second feeding gear 51.

As such, power may be shut off to the tray feeder 50, and printing media placed in the cassette 20 may be fed to the image former of the main body 10 in order to drive the cassette feeder 40.

As such, the power switching unit 80 may transmit or shut off power to the tray feeder 50 according to movement of the multipurpose tray 30 and, thus, when the multipurpose tray 30 is positioned at the non-use position, the tray feeder 50 may not be driven.

Accordingly, when printing media are fed through the cassette 20, the tray feeder 50 may not be driven, thereby preventing power from being unnecessarily consumed through the tray feeder 50 and also preventing noise from being generated according to unnecessary driving of the tray feeder 50.

The first swing member 81 of the power switching unit 80 may be rotated according to external force that is exerted by a user in order to move or open and close the multipurpose tray 30 so as to selectively transmit power to a tray feeder.

As such, a structure of the image forming apparatus 1 may be simplified in that separate power and control are not required to drive the power switching unit 80.

As illustrated in FIGS. 4 and 5, the image forming apparatus 1 may further include a link detection sensor 90 for detecting the link member 83.

The link detection sensor 90 may detect a position of the link member 83 that is operatively associated with the multipurpose tray 30 and, in detail, may detect a position of a rod connector 833 to which the first rod 831 and the second rod 832 are connected.

The controller may determine a position of the multipurpose tray 30 that is operatively associated with the link member 83 based on the position of the link member 83, which is detected through the link detection sensor 90.

The link detection sensor 90 may include a generally used illumination sensor, distance measuring sensor, and so on and may detect the position of the link member 83 or a distance between the link detection sensor 90 and the link member 83.

For example, as illustrated in FIG. 4, when the link detection sensor 90 detects a state in which the rod connector 833 of the link member 83 is farthest spaced apart from the link detection sensor 90, the controller may determine that the multipurpose tray 30 operatively associated with the link member 83 is positioned at the non-use position.

As illustrated in FIG. 5, when the multipurpose tray 30 is converted into the use position from the non-use position, the rod connector 833 may be moved closest to the link detection sensor 90. In this case, when the link detection sensor 90 detects this position of the rod connector 833, the controller may determine that the multipurpose tray 30 is positioned at the use position.

When the link detection sensor 90 detects a state in which the rod connector 833 is positioned between a position farthest spaced apart from the link detection sensor 90 and a position closest to the link detection sensor 90, the controller may determine that the multipurpose tray 30 is positioned between the use position and non-use position and recognize a movement degree or an opening and closing degree of the multipurpose tray 30.

When the controller determines that the multipurpose tray 30 is positioned at the use position, the image forming apparatus 1 may display information indicating that printing media is capable of being fed through the multipurpose tray 30, on the display unit 11, and when the controller determines that the multipurpose tray 30 is positioned at the non-use position, the image forming apparatus 1 may display information indicating that printing media is capable of being fed through the cassette 20, on the display unit 11.

The information displayed on the display unit 11 may be transmitted to remote electronic devices (not shown) connected to the image forming apparatus 1 via a network so as to transmit information about a feeding method of the image forming apparatus 1 to remote users.

When the multipurpose tray 30 is positioned between the use position and the non-use position, for example, when the multipurpose tray 30 is not accurately positioned at the non-use position like in a state in which the multipurpose tray 30 is not completely folded, the controller may pre-shut off power to the tray feeder 50 so as to prevent unnecessary attempt of feeding of printing media from the multipurpose tray 30.

The multipurpose tray 30 may further include a printing media detection sensor (not shown) for detecting whether there is printing media in the multipurpose tray 30.

The printing media detection sensor may include an illumination sensor, an interference sensor that may interfere with placed printing media, or the like.

As such, when the controller determines that the multipurpose tray 30 is positioned at the use position and, simultaneously there is no sheet in the multipurpose tray 30 positioned at the use position, the controller may display information indicating that printing media needs to be placed, on the display unit 11.

The information indicating that printing media needs to be placed in the multipurpose tray 30 may be transmitted to remote electronic devices connected to the image forming apparatus 1 via a network so as to easily transmit information indicating that printing media needs to be placed in order to feed printing media through the multipurpose tray 30 even to remote users.

Figure 6:
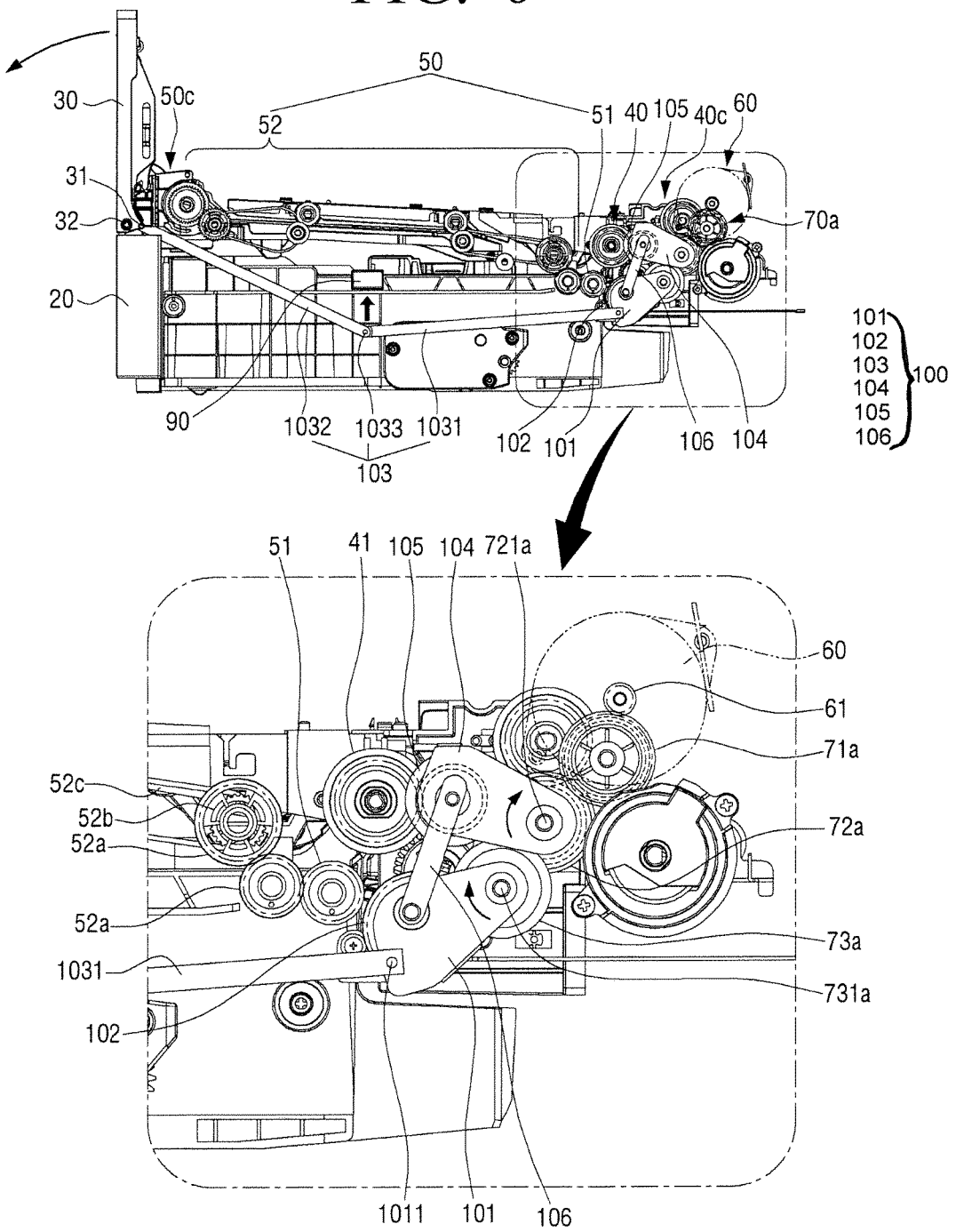
FIG. 6 is a side view of some components of an image forming apparatus including a power switching unit in a state in which a multipurpose tray of an image forming apparatus is positioned at a non-use position, according to another exemplary embodiment of the present disclosure.
Figure 7:
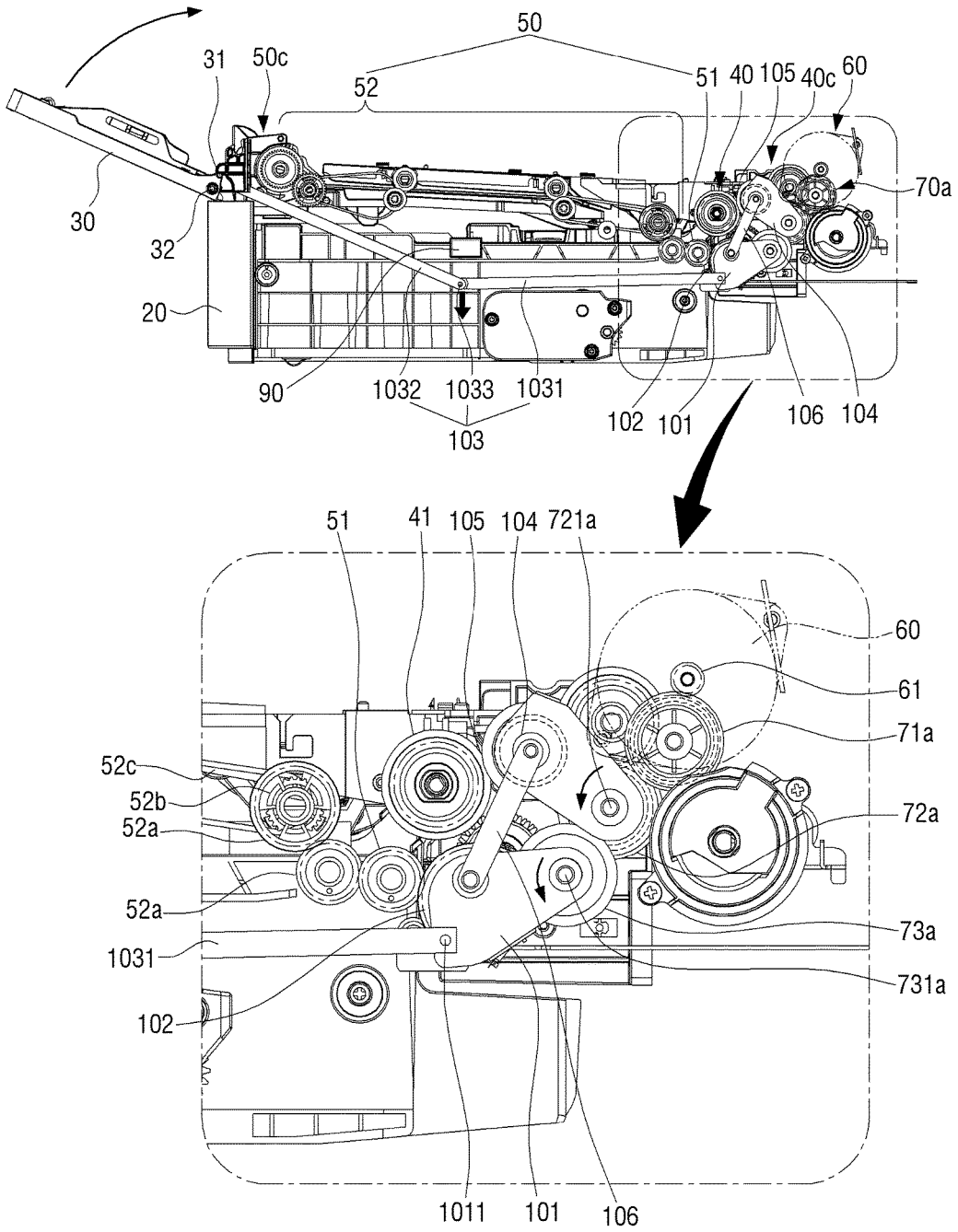
FIG. 7 is a side view of some components of an image forming apparatus including a power switching unit in a state in which a multipurpose tray of the image forming apparatus illustrated in FIG. 6 is positioned at the use position.

FIG. 6 is a side view of some components of an image forming apparatus 2 including a power switching unit 100 in a state in which the multipurpose tray 30 of the image forming apparatus 2 is positioned at the non-use position, according to another exemplary embodiment of the present disclosure. FIG. 7 is a side view of some components of the image forming apparatus 2 including the power switching unit 100 in a state in which the multipurpose tray 30 of the image forming apparatus 2 illustrated in FIG. 6 is positioned at the use position.

The image forming apparatus 2 according to another exemplary embodiment of the present disclosure has the same components except for a power train and a power switching unit as the image forming apparatus 1 according to the aforementioned exemplary embodiment of the present disclosure and, thus, a repeated description thereof will be omitted, and, hereinafter, the image forming apparatus 2 will be described in terms of a power train 70*a* and the power switching unit 100 of the image forming apparatus 2.

The image forming apparatus 2 may include a paper feeder for moving printing media placed in the cassette 20 or the multipurpose tray 30 to the image former.

The paper feeder may include the cassette feeder 40 for feeding printing media placed in the cassette 20 to the image former of the main body 10, the tray feeder 50 for feeding printing media placed in the multipurpose tray 30 to the image former of the main body 10, the driving motor 60 for supplying power to the paper feeder, the power train 70*a* for transmitting power generated from the driving motor 60, and the power switching unit 100 that is operatively associated with the multipurpose tray 30.

The power train 70*a* may include a plurality of gears and transmit power from the driving motor 60 to the cassette feeder 40 and the tray feeder 50 through a plurality of gears.

As illustrated in FIGS. 6 and 7, the power train 70*a* may include first and third sequentially engaging gears 71*a* to 73*a*.

When the power switching unit 100 is operatively associated with the multipurpose tray 30 so as to position the multipurpose tray 30 at the use position, the power train 70*a* may be connected to the tray feeder 50 and, simultaneously, the power train 70*a* may be disconnected from the cassette feeder 40, and when the multipurpose tray 30 is positioned at the non-use position, the power train 70*a* may be disconnected from the tray feeder 50 and, simultaneously, the power train 70*a* may be connected to the cassette feeder 40.

In detail, the power switching unit 100 may include a first swing member 101, a first swing gear 102, a link member 103, a second swing member 104, a second swing gear 105, and a swing link 106.

The first swing member 101, the first swing gear 102, and the link member 103 are similar to the first swing member 81, the first swing gear 82, and the link member 83 according to the aforementioned exemplary embodiment of the present disclosure.

The first swing member 101 may have one end that is rotatably connected to a shaft 731*a* of the third gear 73*a* so as to be rotated around the shaft 731*a* of the third gear 73*a* and the first swing gear 102 may be disposed at the other end of the first swing member 101 so as to engage with the third gear 73*a*.

The link member 103 may connect the first swing member 101 and the multipurpose tray 30.

As such, the link member 103 may be moved in association with the multipurpose tray 30 as the multipurpose tray 30 is moved to the use position or the non-use position and may rotate the first swing member 101 connected to the link member 103 around the shaft 731*a* of the third gear 73*a*.

The first swing gear 102 disposed in the first swing member 101 may be positioned at the first connection position in which the first swing gear 102 is connected to the tray feeder 50 or the first disconnection position in which the first swing gear 102 is disconnected from the tray feeder 50 according to rotation of the first swing member 101.

The second swing member 104 may have one end that is rotatably connected to a shaft 721*a* of the second gear 72*a* so as to be rotated around the shaft 721*a* of the second gear 72*a* and the second swing gear 105 may be disposed at the other end of the second swing member 104 so as to engage with the second gear 72*a*.

A swing link 106 may connect the first swing member 101 and the second swing member 104 and, accordingly, the second swing member 104 may be rotated in association with the first swing member 101 that is rotated in association with the link member 103.

The second swing gear 105 disposed in the second swing member 104 may be positioned at the second connection position in which the second swing gear 105 is connected to the cassette feeder 40 or the second disconnection position in which the second swing gear 105 is disconnected from the cassette feeder 40 according to rotation of the second swing member 104.

As illustrated in FIG. 6, when the multipurpose tray 30 is positioned at the non-use position, the first swing gear 102 connected to the first swing member 101 may be positioned at the first disconnection position in which the first swing gear 102 is disengaged from the second feeding gear 51 of the tray feeder 50.

The second swing gear 105 connected to the second swing member 104 may be positioned at the second connection position in which the second swing gear 105 is engaged with the first feeding gear 41 of the cassette feeder 40.

Accordingly, power transmitted to the first swing member 101 through the third gear 73*a* is not transmitted to the second feeding gear 51 and, thus, the tray feeder 50 is not driven, whereas power transmitted to the second swing gear 105 through the second gear 72*a* is transmitted to the first feeding gear 41 to drive the cassette feeder 40 and, thus, printing media placed in the cassette 20 may be fed to the image former of the main body 10.

As illustrated in FIG. 7, when the multipurpose tray 30 is converted into the use position from the non-use position, the link member 103 may be moved according to movement of the multipurpose tray 30 through a second rod 1032 that is pivotally connected to the connector 31 of the multipurpose tray 30.

Accordingly, the first swing member 101 that is pivotally connected to a first rod 1031 may be rotated around the shaft 731*a* of the third gear 73*a* according to movement of the link member 103 and, thus, the first swing gear 102 may be positioned at the first connection position engaged with the second feeding gear 51 and the second swing gear 105 engaged with the second swing member 104 may be positioned at the second disconnection position in which the second swing gear 105 is disengaged from the first feeding gear 41.

Accordingly, power transmitted to the first swing member 101 through the third gear 73*a* may be transmitted to the second feeding gear 51 to drive the tray feeder 50 so as to feed printing media placed in the multipurpose tray 30 to the image former of the main body 10, whereas power transmitted to the second swing gear 105 through the second gear 72*a* may not be transmitted to the first feeding gear 41 and, thus, the cassette feeder 40 may not be driven.

As such, the power switching unit 100 selectively transmits only any one of the cassette feeder 40 and the tray feeder 50 according to movement of the multipurpose tray 30 and, thus, when the cassette feeder 40 is driven, the tray feeder 50 may not be driven, and when the tray feeder 50 is driven, the cassette feeder 40 may not be driven.

As such, power of the driving motor 60 may be effectively used without loss of power and noise due to an operation of an operation of the paper feeder may also be effectively reduced.

Figure 8:
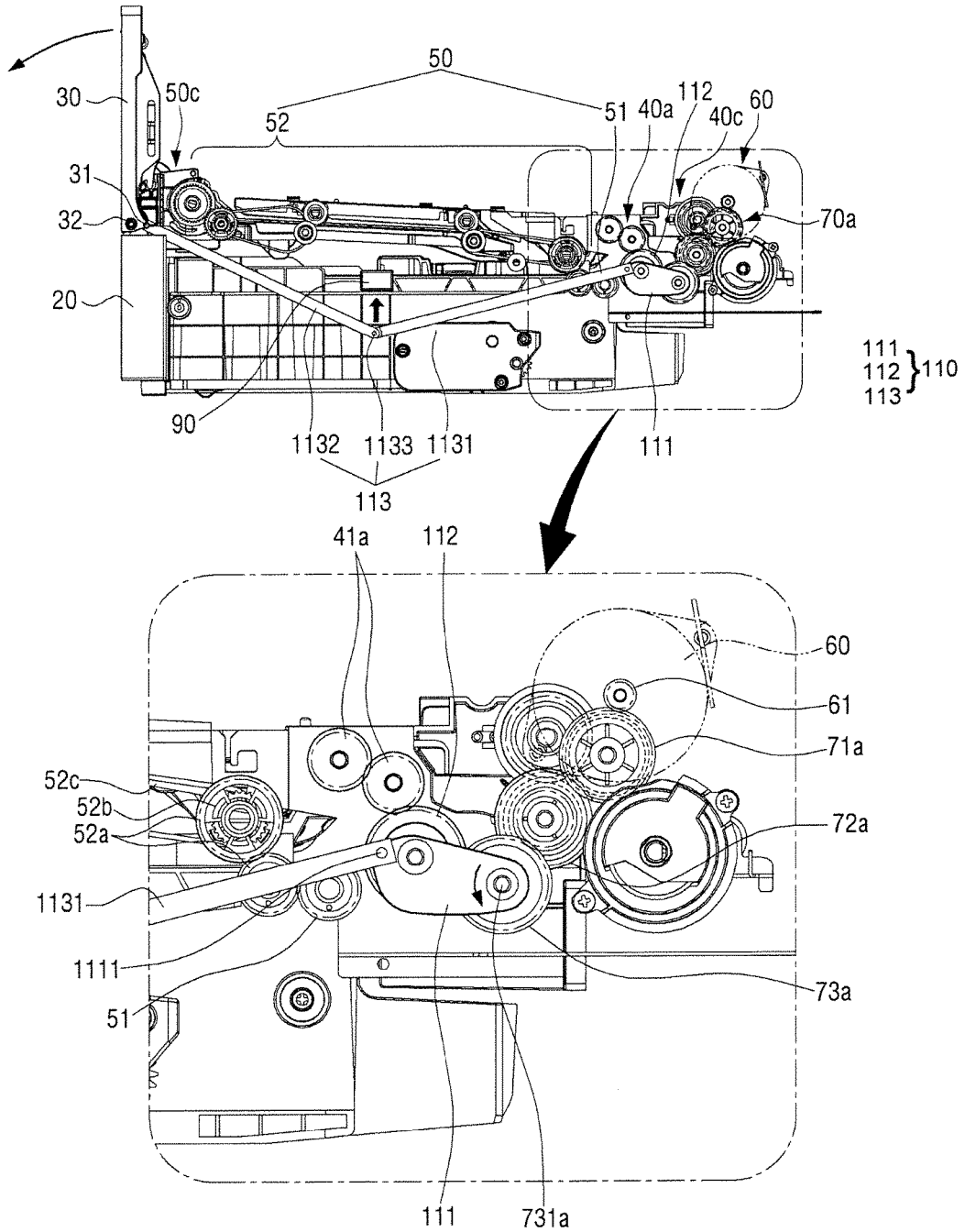
FIG. 8 is a side view of some components of an image forming apparatus including a power switching unit in a state in which a multipurpose tray of an image forming apparatus is positioned at a non-use position, according to another exemplary embodiment of the present disclosure.
Figure 9:
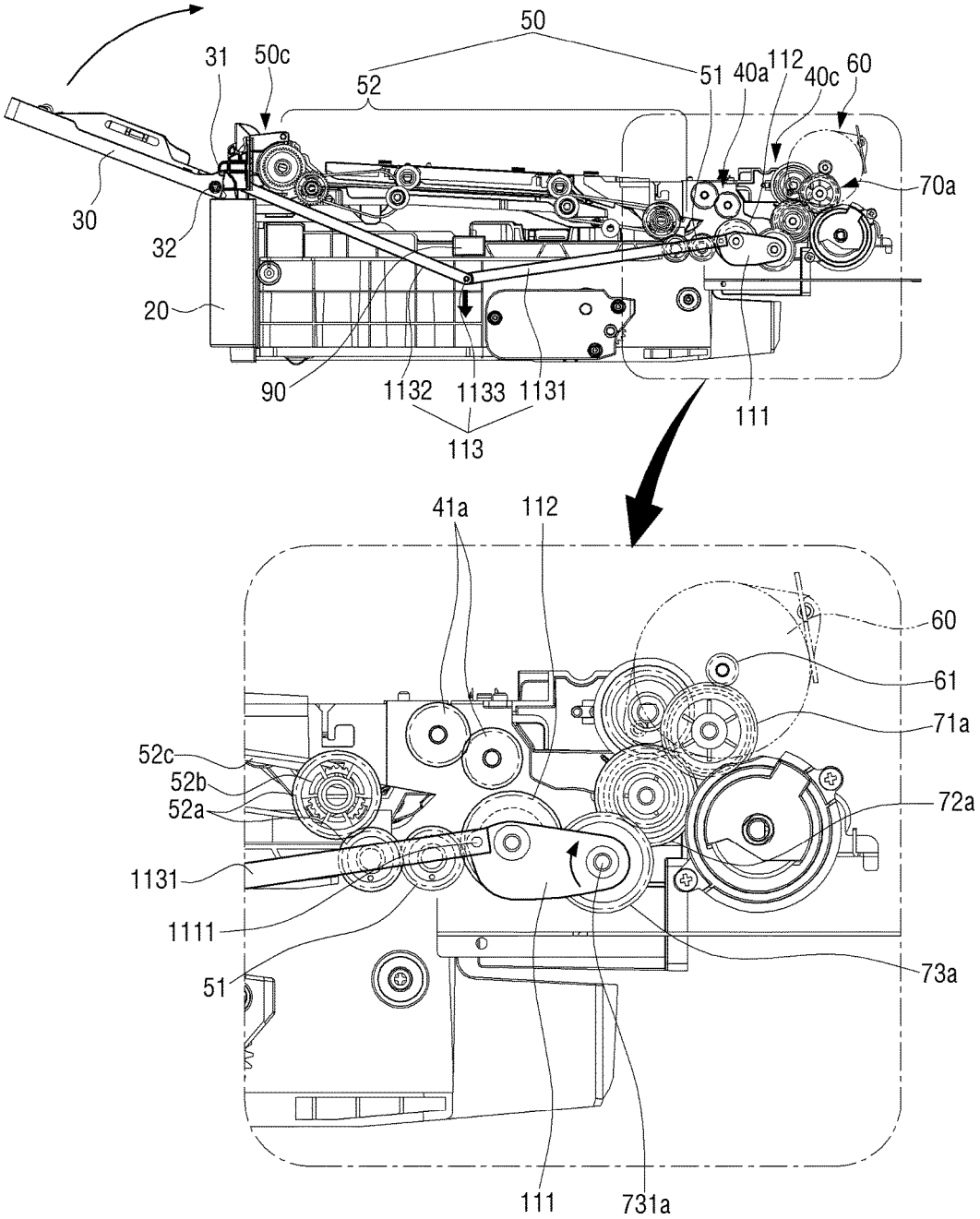
FIG. 9 is a side view of some components of an image forming apparatus including a power switching unit in a state in which a multipurpose tray of the image forming apparatus illustrated in FIG. 8 is positioned at the use position.

FIG. 8 is a side view of some components of an image forming apparatus 3 including a power switching unit 110 in a state in which the multipurpose tray 30 of the image forming apparatus 3 is positioned at the non-use position, according to another exemplary embodiment of the present disclosure. FIG. 9 is a side view of some components of the image forming apparatus 3 including the power switching unit 110 in a state in which the multipurpose tray 30 of the image forming apparatus 3 illustrated in FIG. 8 is positioned at the use position.

The image forming apparatus 3 according to another exemplary embodiment of the present disclosure has the same components except for a cassette feeder, a power train, and a power switching unit as the image forming apparatus 1 according to the aforementioned exemplary embodiment of the present disclosure and, thus, a repeated description thereof will be omitted, and, hereinafter, the image forming apparatus 3 will be described in terms of a cassette feeder 40*a*, the power train 70*a*, and the power switching unit 110.

The power train 70*a* may include first to third sequentially engaging gears 71*a* to 73*a* and receive power from the driving motor 60.

When the power switching unit 110 is operatively associated with the multipurpose tray 30 so as to position the multipurpose tray 30 at the use position, the power train 70*a* may be connected to the tray feeder 50 and, simultaneously, the power train 70*a* may be disconnected from the cassette feeder 40*a*, and when the multipurpose tray 30 is positioned at the non-use position, the power train 70*a* may be disconnected from the tray feeder 50 and, simultaneously, the power train 70*a* may be connected to the cassette feeder 40*a*.

In detail, the power switching unit 110 may include a swing member 111, a swing gear 112, and a link member 113.

The swing member 111 may have one end that is rotatably connected to the shaft 731*a* of the third gear 73*a* so as to be rotated around the shaft 731*a* of the third gear 73*a* and the swing gear 112 may be disposed at the other end of the swing member 111 so as to engage with the third gear 73*a*.

The link member 113 may connect the swing member 111 and the multipurpose tray 30.

The link member 113 may include a first rod 1131 with one end that is pivotally connected to a connector 1111 of the swing member 111 and a second rod 1132 with one end that is pivotally connected to the other end of the first rod 1131 and the other end that is pivotally connected to the connector 31 of the multipurpose tray 30.

As illustrated in FIG. 8, when the multipurpose tray 30 is positioned at the non-use position, the swing gear 112 connected to the swing member 111 may be disconnected from the second feeding gear 51 of the tray feeder 50, whereas the swing gear 112 may be engaged with a first feeding gear 41*a* of the cassette feeder 40*a* so as to feed printing media placed in the cassette 20 to the image former of the main body 10.

As illustrated in FIGS. 8 and 9, when the multipurpose tray 30 is rotated around the rotation shaft 32 in an external direction (counterclockwise based on the drawing) of the main body 10 in order to move the multipurpose tray 30 to the use position from the non-use position, the link member 113 that is operatively associated with the multipurpose tray 30 may be pulled in the external direction of the main body 10.

Accordingly, the swing member 111 may be pulled based on the connector 1111 disposed at an upper end portion of the swing member 111 so as to rotate the swing member 111 counterclockwise.

As such, the swing gear 112 may be engaged with the second feeding gear 51 so as to feed printing media placed in the multipurpose tray 30 to the image former of the main body 10, whereas the swing gear 112 may be disengaged from the first feeding gear 41*a* and, thus, the cassette feeder 40*a* may not be driven.

As illustrated in FIGS. 8 and 9, the first feeding gear 41*a* includes one pair of gears and, thus, even if the first feeding gear 41*a* sequentially receives power through the first gear 71*a*, the second gear 72*a*, the third gear 73*a*, and the swing gear 112, the first feeding gear 41*a* may transmit rotation power to the first feeding roller in the same direction as the first feeding gear 41 that sequentially receives power through the first gear 71, the second gear 72, and the fourth gear 74 according to an exemplary embodiment of the present disclosure.

As such, the image forming apparatus 3 according to another exemplary embodiment of the present disclosure may selectively transmit power to only any one of the cassette feeder 40 and the tray feeder 50 through the single swing member 111 and the single swing gear 112 according to movement of the multipurpose tray 30.

Thereby, components of the power switching unit may be minimized and, thus, power of the driving motor 60 may be effectively used without loss of power and noise due to an operation of an operation of the paper feeder may also be effectively reduced.

Figure 10:
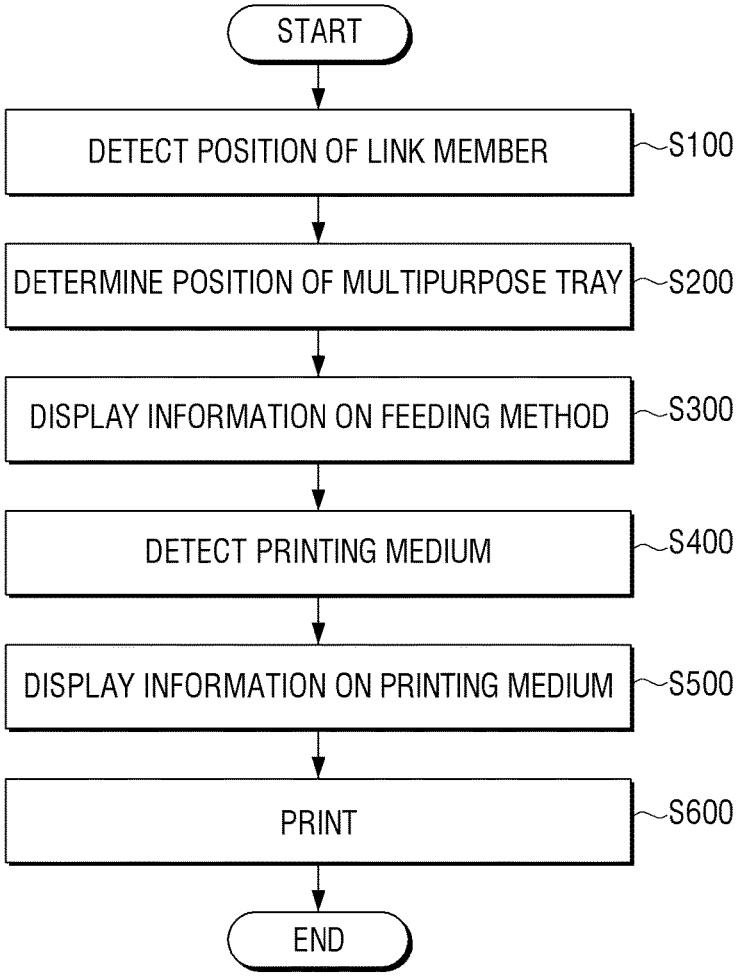
FIG. 10 is a diagram illustrating operations of a method of controlling an image forming apparatus according to an exemplary embodiment of the present disclosure.

FIG. 10 is a diagram illustrating operations of a method of controlling the image forming apparatus 1 according to an exemplary embodiment of the present disclosure.

The method of controlling the image forming apparatus 1 according to the following exemplary embodiment of the present disclosure is the same as a method of controlling the image forming apparatuses 2 and 3 according to other embodiments of the present disclosure and, thus, a method of controlling the image forming apparatus 1 will be described based on the image forming apparatus 1 according to an exemplary embodiment of the present disclosure with reference to FIG. 10.

When the image forming apparatus 1 begins to operate and receives a print command, the image forming apparatus 1 may detect a position of the rod connector 833 of the link member 83 or the link member 83 through the link detection sensor 90 (S100).

The controller may determine a position of the multipurpose tray 30 that is operatively associated with the link member 83 through the position of the link member 83, detected through the link detection sensor 90 (S200).

As described above, since the link member 83 is moved in association with movement of the multipurpose tray 30 to the use position or the non-use position, the position of the link member 83 may be detected through the link detection sensor 90 and, thus, the controller may determine the position of the multipurpose tray 30.

When the position of the multipurpose tray 30 is determined through the controller, information about a feeding method may be displayed (S300).

The information about the feeding method refers to information indicating whether printing media are fed to the image former of the main body 10 through the cassette 20 or printing media are fed to the image former of the main body 10 through the multipurpose tray 30 according to the position of the multipurpose tray 30, determined through the controller.

Upon determining that the multipurpose tray 30 is positioned at the use position, the controller may display information about the feeding method, indicating that printing media are capable of being fed to the image forming apparatus 1 through the multipurpose tray 30, through a display and, upon determining that the multipurpose tray 30 is positioned at the non-use position, the controller may display information about the feeding method, indicating that printing media are capable of being fed through the cassette 20, on the display unit 11.

As described above, the information about the feeding method displayed on the display unit 11 may be transmitted to remote electronic devices (not shown) connected to the image forming apparatus 1 via a network so as to transmit information about the feeding method to remote users.

When the position of the multipurpose tray 30, detected through the link detection sensor 90, is determined to be positioned between the use position and the non-use position, information indicating that the multipurpose tray 30 is not positioned at a normal position may be displayed so as to guide a user to accurately move the multipurpose tray 30 to the use position or the non-use position.

When information about a feeding method through the cassette 20 or the multipurpose tray 30 is recognized, printing media in the cassette 20 or the multipurpose tray 30 may be detected through a printing media detection sensor (S400).

The information about the printing media detected through the printing media detection sensor may include information about the number, type, and so on of placed printing media as well as information about whether printing media are placed in the cassette 20 or the multipurpose tray 30 for feeding printing media to the image former of the main body 10.

The printing media detection sensor may be disposed in each of the cassette 20 and the multipurpose tray 30.

Hereinafter, an example in which a printing media detection sensor detects whether there is printing media will be described for convenience of description.

As such, the controller may determine whether the multipurpose tray 30 is positioned at the use position or the non-use position and, simultaneously, determine whether there is printing media placed in the cassette 20 and the multipurpose tray 30.

When information about printing media is detected, the information about printing media may be displayed (S500).

For example, the controller that determines that the multipurpose tray 30 is positioned at the use position may determine whether printing media are placed in the multipurpose tray 30 through the printing media detection sensor disposed in the multipurpose tray 30.

When there is no printing media in the multipurpose tray 30, the controller may display information about printing media, indicating that printing media needs to be placed in the multipurpose tray 30, through the display unit 11 or transmit the information about printing media to remote electronic devices connected to the image forming apparatus 1 via a network so as to easily transmit information indicating that printing media need to be placed in the multipurpose tray 30 even to remote users.

In addition, information about the number, type, and so on of printing media positioned in the multipurpose tray 30 may be displayed.

The controller determining that the multipurpose tray 30 is positioned at the non-use position may determine whether there is printing media placed in the cassette 20 through the printing media detection sensor disposed in the cassette 20, and when there is no printing media in the cassette 20, the controller may transmit information indicating that printing media need to be placed in the cassette 20 through the display unit 11 or a network.

Then, printing media may be fed to the image former of the main body 10 from the cassette 20 or the multipurpose tray 30 so as to be printed (S600).

As such, the method of controlling the image forming apparatus 1 according to an exemplary embodiment of the present disclosure may detect a position of the link member 83 that is operatively associated with the multipurpose tray 30 so as to easily information about a feeding method through the cassette 20 or the multipurpose tray 30 and to transmit the information to a user.

In the aforementioned method of controlling the image forming apparatus 1, some operations may be repeated, an order thereof may be changed, or some operations may be substituted with other operations.

Thus far, although various exemplary embodiments of the present disclosure have been separately described, the exemplary embodiments are not inevitably embodied alone and configurations and operations of the exemplary embodiments may be combined with at least one embodiment.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. An image forming apparatus, comprising:

a tray feeder to feed a printing medium placed on a tray of the image forming apparatus, to an image former of the image forming apparatus, the tray moveable to be in a first position and a second position;

a cassette feeder to feed a printing medium placed in a cassette of the image forming apparatus, to the image former;

a power train to transmit power generated from a driving motor; and a power switching unit to switch the power transmitted from the power train to:

the tray feeder when the tray is in the first position, to feed a printing medium placed on the tray to the image former, and the cassette feeder when the tray is in the second position, to feed a printing medium placed in the cassette.

2. The image forming apparatus as claimed in claim 1, wherein:

the power switching unit is to connect the power train to the tray feeder when the tray is in the first position; and the power switching unit is to disconnect the power train from the tray feeder when the tray is in the second position.

3. The image forming apparatus as claimed in claim 2, wherein:

the power train is to transmit power to the cassette feeder; and the cassette feeder comprises:

a feeding roller; and a clutch to shut off transmitting power from the power train to the feeding roller when the tray is in the first position.

4. The image forming apparatus as claimed in claim 2, wherein:

the power train comprises a plurality of gears; and the power switching unit further comprises:

a first swing member having a first end rotatably connected to a shaft of a gear among the plurality of gears;

a link member to connect the first swing member and the tray; and a first swing gear disposed at a second end of the first swing member, so as to engage with the gear, the shaft of which is connected to the first end of the first swing member.

5. The image forming apparatus as claimed in claim 4, wherein the link member comprises:

a first rod having a first rod end pivotally connected to the first swing member; and a second rod having a first-connecting end pivotally connected to a second rod end of the first rod and a second-connecting end pivotally connected to the tray.

6. The image forming apparatus as claimed in claim 4, wherein:

the link member is to rotate the first swing member, operating in association with the tray; and the first swing gear is, according to rotating of the first swing member, positionable at:

a first connection position in which the first swing gear is connected to the tray feeder, and a first disconnection position in which the first swing gear is disconnected from the tray feeder.

7. The image forming apparatus as claimed in claim 6, wherein:

the power switching unit is to disconnect the power train from the cassette feeder when the tray is in the first position; and the power switching unit is to connect the power train to the cassette feeder when the tray is in the second position.

8. The image forming apparatus as claimed in claim 7, wherein:

when the first swing gear is positioned at the first connection position, the first swing gear is disconnected from the cassette feeder; and when the first swing gear is positioned at the first disconnection position, the first swing gear is connected to the cassette feeder.

9. The image forming apparatus as claimed in claim 7, wherein the power switching unit further comprises:

a second swing member having a first connecting end rotatably connected to a shaft of a gear from among the plurality of gears;

a second swing gear disposed at a second connecting end of the second swing member, so as to engage with the gear, the shaft of which is connected to the first connecting end of the second swing member; and a swing link to connect the first swing member and the second swing member.

10. The image forming apparatus as claimed in claim 9, wherein:

the swing link is to rotate the second swing member, operating in association with the first swing member; and the second swing gear is, according to rotating of the second swing member, positionable at:

a second connection position in which the second swing gear is connected to the cassette feeder, and a second disconnection position in which the second swing gear is disconnected from the cassette feeder.

11. The image forming apparatus as claimed in claim 10, wherein:

when the first swing gear is positioned at the first connection position, the second swing gear is positioned at the second disconnection position; and when the first swing gear is positioned at the first disconnection position, the second swing gear is positioned at the second connection position.

12. The image forming apparatus as claimed in claim 4, further comprising:

a link detection sensor to detect a position of the link member; and a controller to determine a position of the tray according to the detected position of the link member.

13. The image forming apparatus as claimed in claim 12, further comprising a printing media detection sensor to obtain information corresponding to a printing medium placed in the cassette and the tray.

14. An image forming apparatus, comprising:

a tray feeder to feed a printing medium placed on a tray of the image forming apparatus, to an image former of the image forming apparatus, the tray moveable to be in a first position and a second position;

a cassette feeder to feed a printing medium placed in a cassette of the image forming apparatus, to the image former;

a power train comprising a plurality of gears to transmit power generated from a driving motor; and a power switching unit to operate in association with the tray, to:

connect the power train to the tray feeder to switch the power transmitted from the power train to the tray feeder when the tray is in the first position, and connect the power train to the cassette feeder to switch the power transmitted from the power train to the tray feeder when the tray is in the second position.

15. The image forming apparatus as claimed in claim 14, wherein:

the power switching unit comprises:

a swing member having a first end rotatably connected to a shaft of a gear among the plurality of gears;

a link member to connect the swing member and the tray; and a swing gear disposed at a second end of the swing member, so as to engage with the gear, the shaft of which is connected to the first end of the swing member; and the swing gear is to be selectively connected to the cassette feeder and the tray feeder, to switch the power transmitted from the power train, according to rotating of the swing member.

16. A method of controlling an image forming apparatus for selectively feeding a printing medium placed in a cassette or on a tray to an image former of a main body, the method comprising:

detecting a position of a power switching unit to switch power transmitted from a power train, the power train to transmit the power from a driving motor of the image forming apparatus to:

a cassette feeder to be driven by the power to feed a printing medium placed in the cassette to the image former, and a tray feeder to be driven by the power to feed a printing medium placed on the tray to the image former, the position including:

a first position to switch the power to the cassette feeder, and a second position to switch the power to the tray feeder; and determining whether a feeding of a printing medium is to be from the cassette or the tray, according to the detected position of the power switching unit.

17. The method as claimed in claim 16, further comprising displaying feeding information corresponding to the determined feeding, on a display unit.

18. The method as claimed in claim 17, further comprising transmitting the displayed feeding information to a remote electronic device remotely connected to the image forming apparatus.

19. The method as claimed in claim 16, further comprising detecting printing medium information corresponding to a printing medium in the cassette or on the tray, according to feeding information corresponding to the determined feeding.

20. The method as claimed in claim 19, further comprising displaying the printing medium information on the display unit.

* * * * *